US008286681B2

(12) United States Patent
Goldman

(10) Patent No.: US 8,286,681 B2
(45) Date of Patent: Oct. 16, 2012

(54) DRYWALL TAPE APPLICATOR AND METHOD OF USING THE SAME

(75) Inventor: Lee Goldman, Millburn, NJ (US)

(73) Assignee: Dura-Tape International, Bloomfield, NJ (US)

( * ) Notice: Subject to any disclaimer, the term of this patent is extended or adjusted under 35 U.S.C. 154(b) by 1340 days.

(21) Appl. No.: 11/893,149

(22) Filed: Aug. 14, 2007

(65) Prior Publication Data

US 2009/0044395 A1 Feb. 19, 2009

(51) Int. Cl.
*B05C 3/12* (2006.01)

(52) U.S. Cl. ..... 156/575; 156/577; 118/405

(58) Field of Classification Search ..... 156/575, 156/574, 577; 118/404, 405
See application file for complete search history.

(56) References Cited

U.S. PATENT DOCUMENTS

| | | | | | |
|---|---|---|---|---|---|
| 2,348,166 | A * | 5/1944 | Viera et al. | ..... | 118/122 |
| 2,679,232 | A * | 5/1954 | Brown | ..... | 118/413 |
| 2,876,730 | A * | 3/1959 | Moore | ..... | 118/43 |
| 3,093,331 | A * | 6/1963 | Carroll | ..... | 242/571.5 |
| 3,344,770 | A * | 10/1967 | Schaefer | ..... | 118/122 |
| 3,669,070 | A * | 6/1972 | Wallace | ..... | 118/102 |
| 4,202,288 | A * | 5/1980 | Davy, Jr. | ..... | 118/41 |
| 4,996,941 | A * | 3/1991 | Mills | ..... | 118/419 |
| 5,029,552 | A * | 7/1991 | Ovens | ..... | 118/419 |
| 5,498,287 | A * | 3/1996 | Barnfield | ..... | 118/43 |
| D438,770 | S * | 3/2001 | Wagner | ..... | D8/51 |
| 2008/0066872 | A1 * | 3/2008 | Rose | ..... | 156/574 |

* cited by examiner

*Primary Examiner* — Mark A Osele

(74) *Attorney, Agent, or Firm* — Sills Cummis & Gross P.C.

(57) ABSTRACT

The present invention relates to a fluid-activated drywall tape applicator. The applicator includes a roll of fluid-activated drywall tape, a container, a lid and at least two slits. In operation the roll of tape is affixed to the applicator and a lead end of the tape is fed through a first slit. Once in the first slit the tape enters the container where the container is filled with a fluid. The fluid saturates the tape and the tape leaves the container through the second slit. After leaving the container via the slit, the tape's adhesive properties are activated and a user may apply the tape to a working surface.

18 Claims, 4 Drawing Sheets

Fig. 5
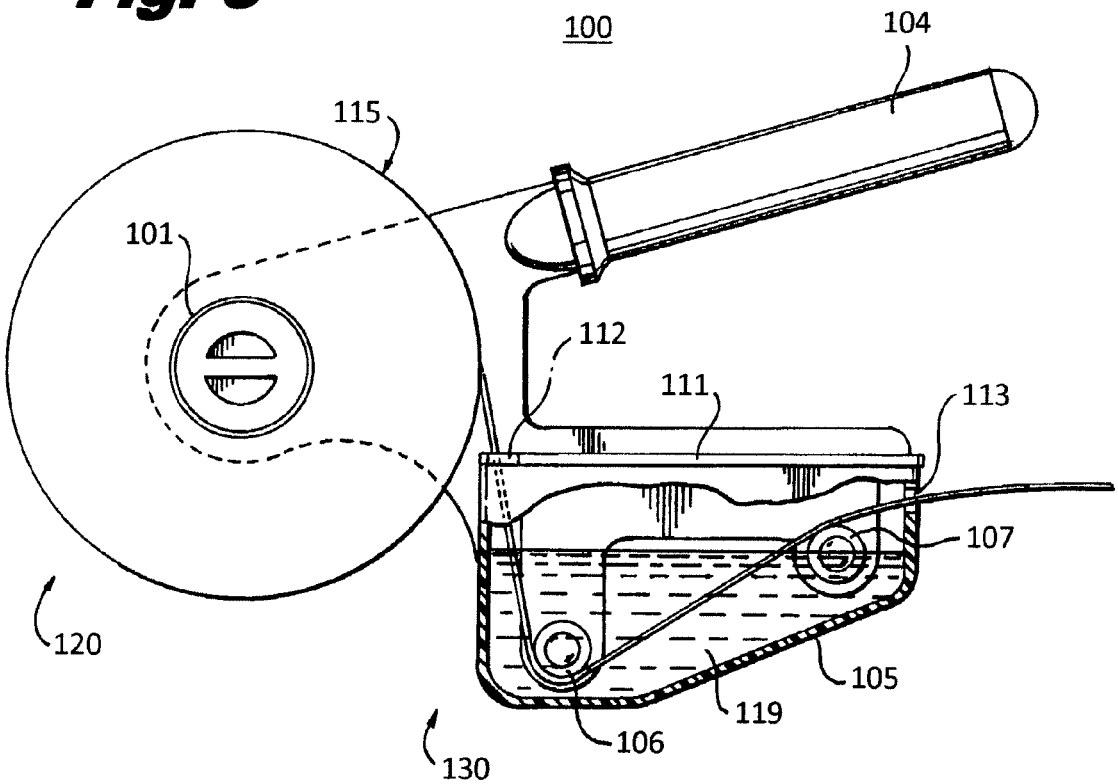
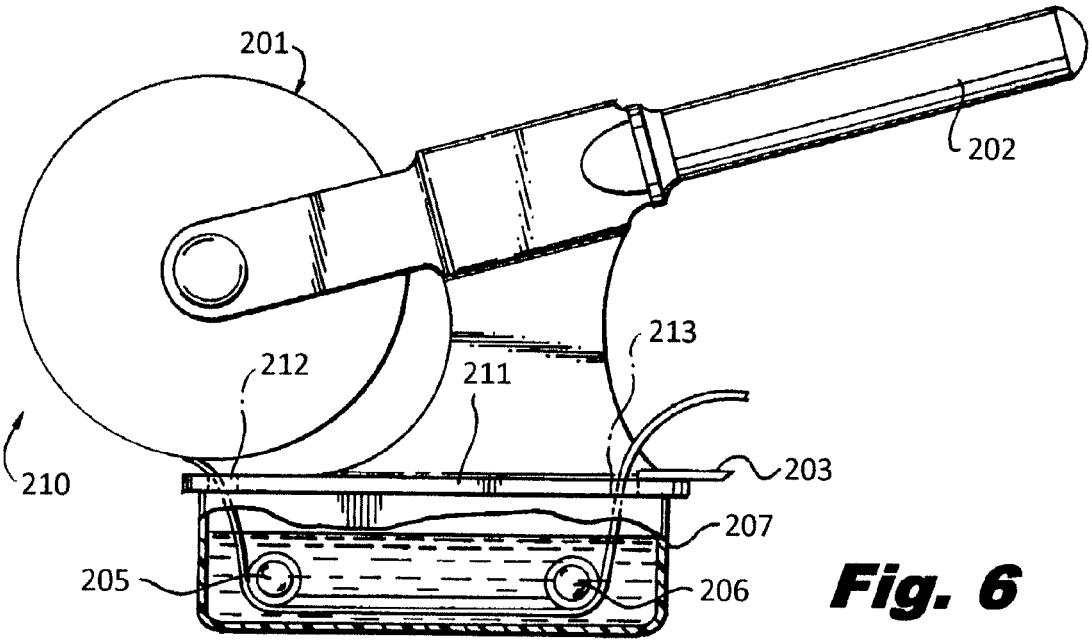
Fig. 6

DRYWALL TAPE APPLICATOR AND METHOD OF USING THE SAME

BACKGROUND OF THE INVENTION

1. Field of the Invention

The present invention relates to a drywall tape applicator. Specifically, the present invention relates to a fluid-activated drywall tape applicator that allows fluid-activated drywall tape to be submerged in a fluid for activation.

2. Prior Art

There is significant commercial interest in the fabrication of drywall tape applicators. But further improved compositions and methods are needed to enhance the application of the drywall tape to surfaces.

The objective of wallboard tape is to join and conceal gypsum drywall segments in a smooth seamless transition from section to section. The standard established procedure for taping wallboards is set in motion after wallboards are secured to a building frame. First, a layer of joint compound, called a bedding layer, is applied (mud or plaster) to cover the spaces between drywall sections. Joint tape is then embedded within the compound running the length of the wallboard joint. After this tape application is completed, an important drying period is required.

Conventional drywall tape is formulated from pulp becoming kraft paper as the finished product. The conventional kraft paper allows the penetration of the moist compound. Depending upon the ambient atmosphere, the aeration time for drying after application of the compound is approximately 18 to 24 hours. The drying is a critical factor so that the joint environment is free of moisture. Moisture breeds mold and mildew that can spread throughout the wallboard perpetuating building decay and promoting a health hazard. This is equally true where the wallboard is of other than gypsum construction.

After the conventional drywall tape is dried, sanding is necessary prior to a second coat of compound covering the tape, again needing to dry fully. Smooth sanding completes preparation for the final finishing, painting, etc. This basic procedure, established in the construction industry, requires two to three time-consuming drying periods, regardless of the basic components found in the compounds used.

To quicken the above conventional process, U.S. Co-pending application Ser. No. 11/129,642 discloses a fluid-activated drywall tape that does not require the amount of time to dry the tape. These tapes are resin-impregnated and have a dry adhesive on the tape. For application, the tape is submerged in a fluid (e.g., water) and applied to the wall joint. Then a sponge, plaster knife or hand used to smooth the compound and make a seamless transition between the wallboards.

For convenience, the drywall tape applicator of the present invention has an improved unique method of applying a fluid-activated drywall tape in roll form to a wall joint.

SUMMARY OF THE INVENTION

The present invention enhances the characteristics of wallboard tape application by providing a fluid-activated drywall tape applicator. This applicator is used in conjunction with a roll of fluid-activated drywall tape as described in U.S. Pending application Ser. No. 11/129,642 entitled "Wallboard Tape and Method of Using the same," filed May 16, 2005, hereby incorporated by reference.

The fluid-activated drywall tape applicator includes a container, a lid and at least two slits. The container is capable of holding a fluid for activating the adhesive properties of the fluid-activated drywall tape while the lid retains the fluid within the container. The two slits are used to receive a lead end of the drywall tape. That is, the lead end is threaded into a first slit and the tape is submerged in fluid within the container and then the lead end is threaded through the second slit with the tape in its activated position. Once activated the tape is ready for application.

In order to hold the fluid-activated drywall tape on the applicator a top roller section is provided. This roller section is mounted on the lid and holds the roll of tape so that the tape may be unrolled from the applicator. The top roller section includes a mounting frame, a spin chock, and an elongate protrusion that receives the spin chock. The roll of tape is removably slid onto the spin chock and held in place by a washer and an end cap or in some instances may be held by a cotter pin.

To wind the tape through the container a bottom roller section is affixed to the bottom side of the lid. This bottom roller section includes a mounting frame and at least one cylindrical roller that has a pair of end caps. The at least one roller is affixed to the mounting frame via the end caps which are attached to the mounting frame via protrusions.

In alternate embodiments a belt clip, a handle and/or a cutting knife may be included. The belt clip is provided for convenience to a user during use of the product, the handle provides an ergonomic feel so that a user hands do not tire during use and the cutting knife easily detaches activated sections of the drywall tape from the applicator.

BRIEF DESCRIPTION OF THE DRAWINGS

These and other features, aspects, and advantages of the apparatus and methods of the present invention will become better understood with regard to the following description and accompanying drawings where:

FIG. 5 is a side view of an assembled applicator according to a second embodiment of the invention; and FIG. 6 is a side view of an assembled applicator according to a third embodiment of the invention.

DETAILED DESCRIPTION OF THE INVENTION

The present invention enhances the characteristics of wallboard tape application by providing a fluid-activated drywall tape applicator. This applicator is used in conjunction with a roll of fluid-activated drywall tape as described in U.S. Pending application Ser. No. 11/129,642 entitled "Wallboard Tape and Method of Using the same," filed May 16, 2005, hereby incorporated by reference.

The wallboard tape includes of a first layer of fibrous material and a water-soluble, water-activated adhesive layer applied to one surface thereof. The tape may be conveniently packaged in roll form as known in the art. The tape may be in a variety of widths, mostly ranging between one-eighth inch and six inches, and lengths from 20 feet to 600 feet, most commonly approximately 2 feet by 300 feet, which will be normally adequate to cover the gaps formed by abutting wallboards.

Extending between the outer surface and the inner surface of the fibrous layer there may be air-conducting perforations covering substantially the entire area at intervals of one-eighth inch, which may be either punched or spark-perforated. As is known in the art, a preferred centerfold may be employed to enable the tape to be used with angle joints, as well as joints formed by inside corners of a wall. This centerfold, known in the art as a center margin, serves as a rule guide for the user. The adhesive layer is preferably roll-coated using known techniques to conventional thickness. Since resin impregnated paper is mechanically stronger than kraft paper, the fibrous material may be of a lesser thickness than the conventional product.

The tape may be employed either by moistening the adhesive layer using a wetted sponge, immersing the tape roll in a vessel of water, or a dispensing device that may or may not incorporate a wetted sponge. Preferably, a sponge, plaster knife or hand brushing of the applied tape length across the joint takes place after application to ensure proper contact, bonding wetness and a smooth drying result.

The wetting is facilitated by the fact that the paper layer which is resin impregnated does not absorb and retain substantial amounts of moisture, which also facilitates subsequent drying of the adhesive. As a result, the tape is sufficiently dried and ready for the application of a finish coat of plaster compound in most cases less than an hour.

Figure 1:
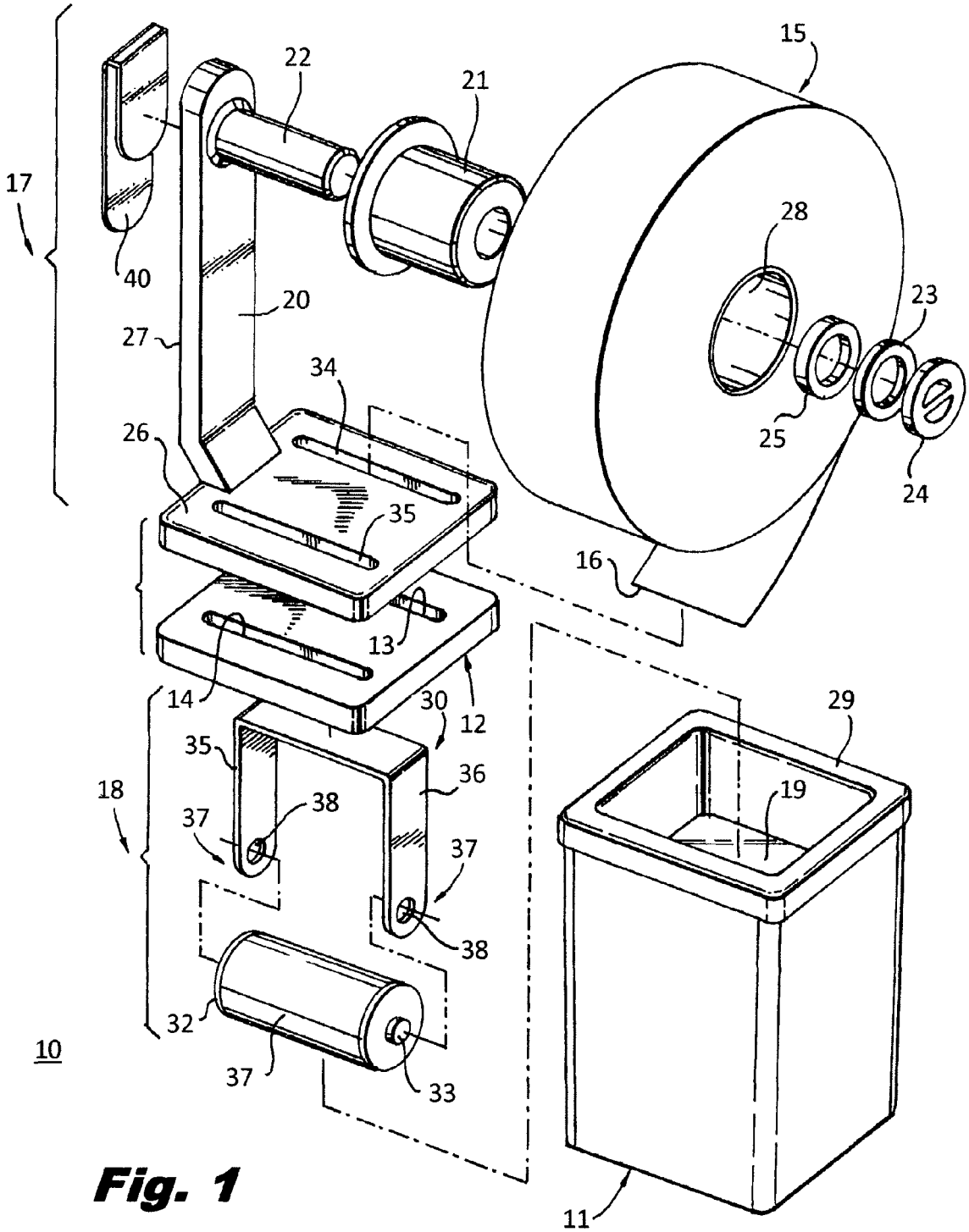
FIG. 1 is a prospective view of a disassembled applicator according to a first embodiment of the present invention.

FIG. 1 shows an unassembled fluid-activated drywall tape applicator 10. The applicator 10 includes a container 11, a lid 12 and at least two slits 13, 14.

The container 11 is capable of holding a fluid 14 for activating adhesive qualities of the fluid-activated drywall tape 15. The container 11 has an outer edge 29 that encompasses the entire upper lip of the container 11. The outer edge 29 is used to encounter the lid 12 as will be described below. The container 11 is approximately 100 to 110 mm in height, 90 mm in width and 120 mm in length. The outer edge 29 of the container 11 overhangs from the container 11 body by about 5 mm. The container 11 holds any fluid 14 that may be used to activate the tape 15. The most common fluid 14 being water.

The lid 12 retains the fluid 14 within the container 11. The lid 12 frictionally snaps onto the outer edge 29 of the container 11 for a tight, waterproof fit. In this embodiment, the lid 12 has two slits 13, 14 located parallel to each other. These slits 13, 14 are used to receive a lead end 16 of the drywall tape 15. That is, the lead end 16 is threaded into a first slit 13 and the tape 15 is submerged in fluid 14 within the container 11 and then the lead end 16 is threaded through the second slit 14 with the tape 15 in its activated position.

In order to hold the fluid-activated drywall tape 15 on the applicator 10 a top roller section 17 is provided. This roller section 17 is mounted via a mounting frame 20 on the lid 12 and holds the roll of tape 15 so that the tape 15 may be unrolled from the applicator 10.

The mounting frame 20 includes a base 26 and a back 27. The base 26 frictionally snaps onto the lid 12 or may be incorporated into the lid 12 at the time of manufacture. In either case the base 26 includes two slits 34, 35 that align with the slits 13, 14 found the lid 12.

The back 27 of the mounting frame 20 extends mostly at a 90 degree angle from the base 26 but, the bottom of the back 27 moves slightly horizontal so as to align the slits 34, 35 with a mounted tape roll 15. The back 27 has a thickness of approximately 10 mm and a height of approximately 100 mm.

Attached to a distal end of the back 27 is an elongate protrusion 22. The elongate protrusion 22 extends from the back 27 at a 90 degree angle. This protrusion 22 is used in conjunction with a spin chock 21. The spin chock 21 is capable of sliding over the protrusion 22 and also fits inside a cylindrical opening 28 of the tape roll 15. Together, the spin chock 21 and protrusion 22 suspend the tape 15 over the lid 12 and aligned the tape 15 with the slits 13, 14 to allow the tape 15 to be feed into the slits 13, 14.

The spin chock 21 is held in place by a washer 23, an end cap 24 and an end-cap lock 25 or in some instances a cotter pin (not shown). To secure the tape roll 15 to the mounting frame 20, the spin chock 21 is fitted into the opening 28 on the tape roll 15 and then slid onto the protrusion 22. The end-cap lock 25 is then fitted into the spin chock 21 and locked onto the protrusion 22. The washer 23 is then slid over the end-cap lock 25 and the end cap 24 is secured to the end-cap lock 25 thereby locking the spin chock 21 to the mounting frame 20. Now the tape roll 15 may spin on the axis of the protrusion 22 without falling off the mounting frame 20. Please note, this is one method for locking the tape roll 15 in place but other methods known in the art may be used.

In order to wind the tape 15 through the container 11 and to ensure the tape 15 is completely immersed in the fluid 14, the applicator 10 includes a bottom roller section 18. This bottom roller section 18 is affixed to the bottom side of the lid 12 or may be incorporated into the lid 12 at the time of manufacture.

The bottom roller section 18 includes a mounting frame 30 and a cylindrical roller 31 that has a pair of end caps 32. The mounting frame 30 extends vertically from the lid 12 and extends to almost the bottom of the container 11. The mounting frame 30 has two sides 35, 36 that taper to a vertex 37. At the vertex 37 of the sides 35, 36, the sides 35, 36 contain two opening 38. These openings 38 are used to fixedly secure the roller 31 to the mounting frame 30. That is, the rollers 31 each include a pair of end caps 32 with each end cap 32 having a protrusion 33. These protrusions 33 snap into the openings 38 on the mounting frame 30. Once snapped in place the roller 31 is capable of spinning on an axis that is on the same plane as the axis of the protrusion 22 of the upper mounting frame 17. This alignment of the tape roll 15 and bottom roller 31 allow the tape 15 to be dispensed in a uniform manner.

Figure 2:
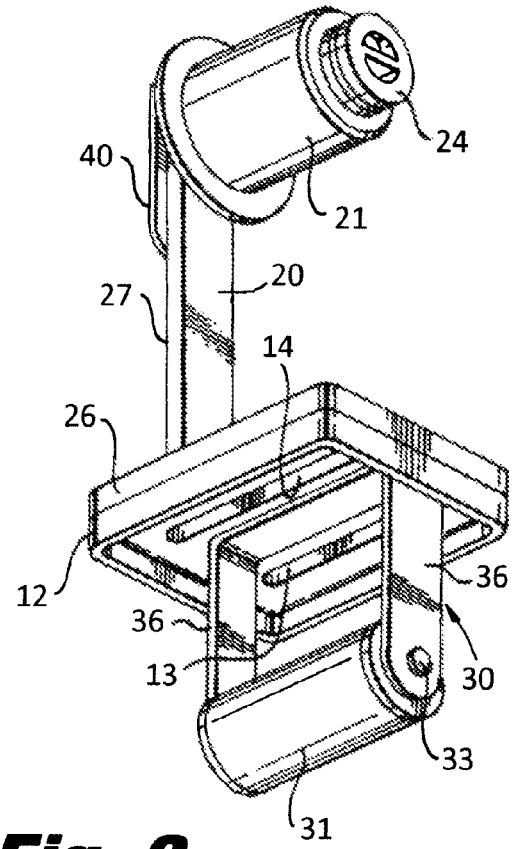
FIG. 2 is a prospective view of the assembled applicator without a container, a tape roll and spin chock.

FIG. 2 shows an assembled applicator 10 without the tape roll 15, the spin chock 22 and the container 11. The lid 12 is connected to both the upper roller section 17 and the bottom roller section 18. The washer 23 and end cap 24 are placed over the end cap lock 25. In order to mount the tape roll 15, the spin chock 22 will be inserted into the opening on the tape roll 28 and the spin chock 22 will be slid onto the protrusion 21 after the washer 23, end-cap lock 25 and end cap 24 are removed. Once the spin chock 22 is in place the washer 23, end-cap lock 25 and end cap 24 will be reapplied allowing the tape roll 15 to spin freely on the protrusion 22.

The bottom roller 31 is affixed on the bottom roller section 18. And the roller 31 is secured to the mounting frame 30 by protrusions 33. This allows the roller 31 to spin freely on the mounting frame 30.

Figure 3:
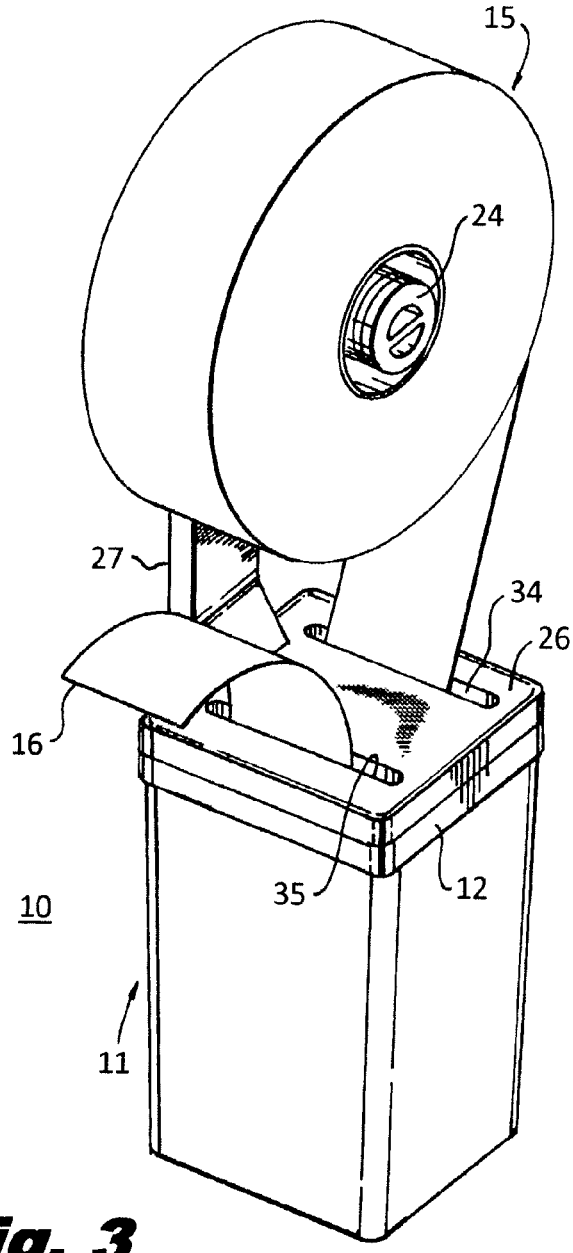
FIG. 3 is a front prospective view of the completely assembled applicator.

FIG. 3 shows the fully assembled applicator 10. The tape 15 is affixed to the spin chock 22 and mounted on the protrusion 21 and the lid 12 is snapped over the lip 29 of the container 11, as described above. In order to thread the tape 15 through the slits 13, 14, it is easiest to remove the lid 12 from the container 11 and thread the lead end 16 of the tape 15 through the first slit 13 around the roller 31 and out of the second slit 14. The lid 12 may then be placed over the fluid-filled container 11 thereby submerging the tape 15 in the fluid 14.

Figure 4:
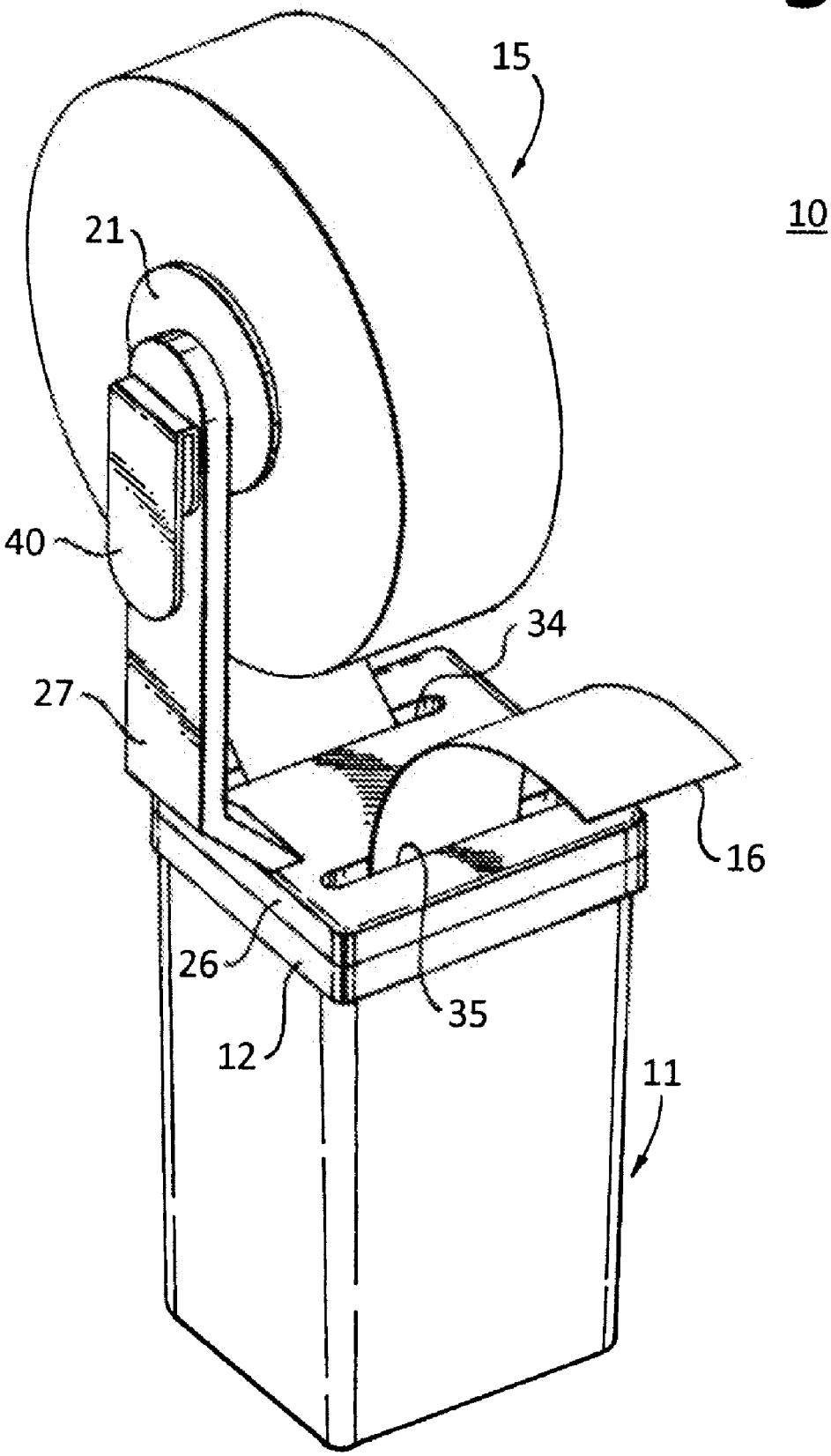
FIG. 4 is a rear prospective view of the completely assembled applicator.

FIG. 4 shows the fully assembled applicator 10 from the rear. The belt clip 40 is attached to the top rear of back of the upper mounting frame 17. This belt clip 40 easily attaches to a user's belt. The belt clip 40 allows the applicator 10 to hang from a user's tool belt so that the user may have use of both of his hands for the application of the tape 15 to the wallboards.

In use, with the lid 12, top roller section 17 and bottom roller section 18 being detached from the container 11 as shown in FIG. 2, a roll of tape 15 is mounted on the spin chock 22 and secured to the mounting frame 20 of the top roller section 17. Once in place a user will take a lead end 16 of the tape 15 and feed the lead end 16 into the first slit 13, the tape 15 is than feed around the roller 31 on the bottom roller section 18 and feed through the bottom of the second slit 14. The tape 15 is feed so that a user may easily grasp the lead end 16 of the tape 15. The container 11 is than filled with a fluid 14 such as water and the lid 12 is securely fastened to the container 11. Since the tape 15 is wrapped around the bottom roller section 18 both the roller and the tape will be completely submerged in water which will activate the tape 15. All a user must do is tug on the lead end 16 of tape 15 and the user will be able to pull out as much activated tape that is needed for covering a particular section of wallboard joints. To detach the tape from the roll the user may tear the length from the roll or cut the length from the roll using a utility knife or any other sharp-surfaced object.

FIG. 5 shows a second embodiment of the present invention. In this embodiment, the applicator 100 has a tape roll mounting system 110 and a container 105. The applicator 100 also includes a lid 111 and two slits 112, 113. Attached to the lid 111 is an upper roller section 120 that affixes the tape roll 101 to the applicator 100. The tape roll 101 is mounted to the upper roller section in a way similar to that found in the first embodiment.

The upper roller section 120 also includes handle 104. The handle 104 allows a user to hold the applicator 100 while applying the tape 101 directly to a wallboard. The handle 104 also provides an ergonomic feel so that a user's hands will not tire during use.

The applicator's two slits 112, 113 are located in different positions than that of the first embodiment. The first slit 112 is located on the lid 111 and the second slit 113 is located on the rear end of the container 105. This configuration allows the tape 101 to be removed from the applicator 100 while applying the tape 105 directly to the wallboards as will be explained more fully below.

The applicator 100 also includes a bottom roller section 130 that includes two rollers 106, 107. The first roller 106 is mounted on the front, bottom of the roller section 130 so that when the tape 101 is feed into the first slit 112, the tape 101 may be fully submerged into the fluid. The second roller 107 is located on the top, rear section of the roller section 130. When the tape 101 is feed into the first slit 112, the tape 101 is sent to the bottom roller 106 to fully submerge the tape 101 in the fluid. The tape 101 is then wrapped around the first roller 106 and sent to the second roller 107 where the tape 101 is feed through the second slit 113. Once the activated tape 102 is feed through the second slit 113 it may be applied directly to the wallboards. Please note, that the container 105 has a different configuration than the first embodiment so that when the applicator 100 is in close proximity to a wall the container 105 will not interfere with the application process.

FIG. 6 shows a third embodiment of the present invention. The third embodiment 200 includes an upper mounting section 210 having a handle 202 as described above. The bottom roller section 220 differs from the second embodiment in that the pair of bottom rollers 205, 206 are both positioned near the bottom of the container 207 with one being in front and the other in the rear. The tape 201 is feed into a first slit 212 located on the lid and feed to wrap around both rollers 205, 206. The tape 201 is then feed out of the container 207.

In this embodiment, the tape 201 is feed out of the second slit 213 and into a cutting knife. The tape 201 may then be applied directly to the wall and cut in one motion. That is, this applicator 200 allows a user to apply the tape 201 directly to a wallboard and the knife 203 is utilized to cut the tape 201 after a desired amount of tape 201 is adhered to the wallboard. The cutting knife 203 is a convenient way to easily detach activated sections of the drywall tape 201 from the applicator 200.

Although the present invention has been described in detail and with particularity, it will be appreciated by those skilled in this art that changes and modifications can be made therein without departing from the scope and spirit of the invention.

What is claimed is:

1. A fluid-activated drywall tape applicator comprising:

a roll of fluid-activated drywall tape, the fluid-activated drywall tape having a lead end;

a container, the container capable of holding a fluid for activating adhesive properties of the fluid-activated drywall tape;

a lid for retaining the fluid within the container;

at least a first slit and a second slit, the first and second slits capable of receiving the lead end of the drywall tape; and a top roller section, the top roller section being frictionally snapped onto the lid, the top roller section including a base, an elongate protrusion and a back, the back extending from the base at a proximal end and attaching to the elongate protrusion at a distal end, the back having a horizontal offset so that when the roll of fluid-activated drywall tape is mounted on the elongate protrusion, the roll of fluid-activated drywall tape will be suspended over the lid and aligned with the first slit.

2. The drywall tape applicator of claim 1 whereby the lead end is threaded into the first slit and then threaded through the second slit.

3. The drywall tape applicator of claim 1 whereby the slits are located on the lid.

4. The drywall tape applicator of claim 1 wherein the top roller section includes a spin chock.

5. The drywall tape applicator of claim 4 wherein the elongate protrusion receives the spin chock.

6. The drywall tape applicator of claim 4 wherein the roll of tape is removable held on the spin chock.

7. The drywall tape applicator of claim 1 wherein the roll of tape is removably affixed to the top roller section by a washer and an end cap.

8. The drywall tape applicator of claim 1 wherein the roll of tape is removably affixed to the top roller section by a cotter pin.

9. The drywall tape applicator of claim 1 further comprising: a bottom roller section.

10. The drywall tape applicator of claim 9 wherein the bottom roller section is affixed to the lid.

11. The drywall tape applicator of claim 9 wherein the bottom roller section includes a mounting frame and at least one roller.

12. The drywall tape applicator of claim 11 wherein the at least one roller is cylindrical.

13. The drywall tape applicator of claim 12 wherein the at least one roller has a pair of end caps.

14. The drywall tape applicator of claim 13 wherein the at least one roller is affixed to the mounting frame via the end caps.

15. The drywall tape applicator of claim 14 wherein the end caps have a protrusion for attaching to the mounting frame.

16. The drywall tape applicator of claim 1 further comprising: a belt clip.

17. The drywall tape applicator of claim 1 further comprising: a handle.

18. The drywall tape applicator of claim 1 further comprising: a cutting knife for detaching a section of the drywall tape from the roll.

* * * * *